US006668400B1

(12) United States Patent
Nichols et al.

(10) Patent No.: US 6,668,400 B1
(45) Date of Patent: Dec. 30, 2003

(54) ARTICLE OF BEDDING WITH POCKET ASSEMBLY

(75) Inventors: Karen G. Nichols, Centennial, CO (US); Bonita Louis Griffin Kaake, Lakewood, CO (US)

(73) Assignee: Wildhide, L.L.C., Centennial, CO (US)

( * ) Notice: Subject to any disclaimer, the term of this patent is extended or adjusted under 35 U.S.C. 154(b) by 0 days.

(21) Appl. No.: 10/249,101

(22) Filed: Mar. 17, 2003

(51) Int. Cl.[7] ..... A47G 9/02
(52) U.S. Cl. ..... 5/485; 5/482; 5/490
(58) Field of Search ..... D6/601; 5/636, 5/639, 482, 485, 490, 495

(56) References Cited

U.S. PATENT DOCUMENTS

| | | | | |
|---|---|---|---|---|
| 3,974,531 A | | 8/1976 | Van Pelt | 5/339 |
| 4,169,428 A | * | 10/1979 | Waugh | 119/482 |
| 4,309,784 A | | 1/1982 | Cohen | 5/442 |
| 4,624,198 A | | 11/1986 | Beam et al. | 112/10 |
| 4,624,200 A | | 11/1986 | Fisher | 112/121.12 |
| 4,688,286 A | | 8/1987 | Miker, Jr. | 5/490 |
| 4,703,528 A | | 11/1987 | Rolle | 5/417 |
| 4,768,245 A | | 9/1988 | Dutton | 5/434 |
| 4,862,438 A | | 8/1989 | Fry | 369/19 |
| 4,877,288 A | | 10/1989 | Lee | 297/229 |
| 5,138,728 A | | 8/1992 | Aston | 5/645 |
| 5,240,330 A | | 8/1993 | Thompson | 383/4 |
| 5,443,880 A | * | 8/1995 | Wike | 428/78 |
| 5,475,886 A | | 12/1995 | Mintz | 5/653 |
| 5,644,807 A | | 7/1997 | Battistella | 5/419 |
| 5,737,785 A | | 4/1998 | Casey | 5/419 |
| 5,864,903 A | | 2/1999 | Newman | 5/639 |
| D409,873 S | * | 5/1999 | Johnson | D6/603 |
| 5,898,962 A | | 5/1999 | McNeal | 5/639 |
| D411,401 S | | 6/1999 | Edick et al. | D6/601 |
| 5,961,018 A | | 10/1999 | Abelbeck et al. | 224/584 |
| 6,216,297 B1 | * | 4/2001 | Lemke | 5/636 |
| D448,960 S | | 10/2001 | Leverette | D6/596 |
| 6,415,466 B1 | | 7/2002 | Laiso | 5/485 |
| 6,541,096 B1 | * | 4/2003 | Richards et al. | 428/99 |

FOREIGN PATENT DOCUMENTS

GB 2173095 A 10/1986

* cited by examiner

*Primary Examiner*—Teri Pham Luu
(74) *Attorney, Agent, or Firm*—Roger A. Jackson

(57) ABSTRACT

An article of bedding with a hidden pocket for storing an item, including a fabric panel with an exterior surface, an interior surface, and a distal end, also, a double inwardly folded wide hem fabric piece defining a first end and a second end, and having a hem interior volume separated from an exterior and an interior environment. Also, a fabric pocket liner including an opening that is double outwardly folded defining a third end and a fourth end, the opening is adjacent to a portion of the first end, the second end, and the distal end, the liner is positioned within a portion of the hem interior volume, the liner is not visible from the exterior and interior environment. The distal end, first end, and third end, are attached. The distal end, first end, and second end are also attached, plus the second end and fourth end are attached.

36 Claims, 3 Drawing Sheets

ARTICLE OF BEDDING WITH POCKET ASSEMBLY

TECHNICAL FIELD

The present invention generally relates to articles of bedding with a hidden or partially hidden pocket assembly for the purpose of storing an item that is convenient to have accessible at one's bedside. More particularly, the present invention utilizes different multiple articles of bedding such as pillow cases, bed sheets, bed skirts, blankets, bed spreads, bed quilts, and the like, that contain a hidden or partially hidden pocket assembly located within or adjacent to the hem piece on the article of bedding. The access to the pocket is hidden from normal viewing, allowing the bed occupant discrete access to the item such as a condom, tissue, cough drop, breath freshener, medications, personal lubricants, and the like, without the need of getting out of bed or turning on the bedroom light.

BACKGROUND OF INVENTION

Convenience has become ever more important in modern day society, witness the rise in the quality and selection of quick prepare microwave foods, fast casual restaurants, instant mobile phone number and phone activation, and Internet purchases of goods and services, all of which were unavailable a few years ago. Taking this concept to the bedroom, wherein items of a personal nature such as condoms, tissues, cough drops, breath freshener, medications, personal lubricants, and the like, are frequently desired in the middle of the night wherein the bed occupant does not desire to have to get up out of bed and/or turn on the bedroom light to find the desired item. Finding the desired item easily by the bed occupant with minimal effort would be of a benefit to the bed occupant in having a minimal disruption of sleep, or in the case of a condom being the desired item, having the condom conveniently available to encourage use of the condom thereby reducing the incidence of sexually transmitted diseases such as AIDS, and other venereal diseases that can have a seriously negative impact on one's health. Convenience and accessibility of the item, especially in the case of the condom, are important as participants in sexual activities are frequently unprepared and in a state of heightened sexual arousal and are unlikely "in the heat of the moment" to take the time and effort to search diligently for a condom, especially if the condom has not been accessed for some time, the bed occupant may not recall the condom's location in the aforementioned situation, thus making it less likely that a condom would be used, resulting in an increased risk to one's health. In response to the desired need for conveniently and easily locating an item of a personal nature by a bed occupant, a number of prior art inventions have added pockets to various articles of bedding.

Starting with the U.S. Pat. No. 5,864,903 to Newman, disclosed is a pillow having a storage pocket sized for retaining a packaged condom. Newman also discloses that the storage pocket is located in the center of one side of the pillow, with the pocket opening being formed in an exterior seam running across one of the pillow faces with only the actual condom pocket being hidden from view. However, the condom pocket is just inside of the seam, wherein the condom pocket access seam is very obvious from viewing the pillow on the outside. This seam appears similar to a side pocket that exists on a purse or handbag, wherein the storage pocket opening is completely visibly exposed on the outside of the pillow. Newman also discloses that the rigidity of the seam, which is as large as the exterior pillow outer edge border seams on the pillow, is used for retaining the condom in the pocket. Continuing in the same area, moving to U.S. Design Patent No. D 448,960 S to Leverette, disclosed is a pillowcase with a condom storage pocket, wherein the condom storage pocket is entirely obvious and visible on the outside surface of the pillowcase. In fact, Leverette shows the condom pocket itself as a transparent piece of material that the condom is stored in, thus not only is the condom storage pocket obvious and visible from the pillowcase outside surface but also due to the transparent pocket the condom package itself is also obvious and visible from the pillowcase outside surface. Further, in this same area in UK (England) Patent Application Publication No. 2,173,095 A by Barton, disclosed is a bed linen such as a pillowcase with a pocket on one surface having a snap closure, the purpose of the pocket is to be used primarily for a child's tooth to be replaced by a coin from the tooth fairy. Barton does not disclose anything related to hiding the pocket from view, being much the same as Leverette having its pocket obvious to viewing as indicated by the Figure in Barton, and to a lesser extent Newman having a the pocket opening obvious to viewing.

Similarly, U.S. Pat. No. 4,688,286 to Miker, Jr., disclosed is a pillow having storage compartment pockets for personal items, wherein the pockets are hidden from view due to the fact that the pockets are placed on the bottom side of the pillow, as there is nothing unique in the structure of the pocket itself to keep it hidden from obvious view. Thus, if the pillow in Miker, Jr. were simply turned over all of the pockets would be totally exposed. Also, in U.S. Pat. No. 4,703,528 to Rolle, disclosed is a ground cover sheet that has a hidden pocket that is in between the fabric layers in the body of the ground cover sheet with the opening to the pocket being sealed with a hook and loop fastener being located at the outer edge of the ground cover sheet hiding the opening. Rolle does not lend itself to bed use for the hidden and discreet storage of personal items with quick and convenient access, being a ground cover with weights and the hidden pocket opening not easily accessible. Finally, in U.S. Pat. No. 5,138,728 to Aston, disclosed is an interior container insert for a pillow that includes an insert bag for containing articles of a personal nature and relies upon a pillowcase for instance to "hide" the container insert with the goal being to provide passive security for valuables stored in the container that is secured by a hook and loop fastener. Again, quick and convenient access for the articles of a personal nature is not the goal in Aston and would not be easily achievable due to the multiple layers that must be gone through to get to the container insert interior.

What is needed is an article of bedding that has a hidden pocket for the discrete storage of personal items, wherein discrete retrieval, quick access, and convenience to these personal items is easily achieved by the bed occupant. Not only is it desired that the pocket be hidden from view, but also the opening to the pocket be hidden from view making the personal items not obvious within the makeup of normal bedding, such as pillowcases, bed sheets, bed skirts, blankets, bed spreads, bed quilts, and the like.

SUMMARY OF INVENTION

The present invention of an article of bedding with a hidden pocket assembly for storing an item, includes a fabric panel having an exterior surface, an interior surface, and a distal end portion. Also included, is a double inwardly folded wide hem fabric piece defining a hem first end portion and a hem second end portion, the hem forming a hem interior volume that is separated from an exterior environment and an interior environment. In addition, a fabric pocket liner is included for storing the item, with the fabric pocket liner including an opening for passing the item therethrough, wherein the pocket liner opening is double outwardly folded defining a pocket liner third end portion and a pocket liner fourth end portion, with the opening positioned adjacent to a portion of the hem first end, a portion of the hem second end, and a portion of the panel distal end. The fabric pocket liner is also positioned within a portion of the hem interior volume, wherein the fabric pocket liner is not visible from the exterior environment and the interior environment. In addition, a means for attachment is provided for the panel distal end, the hem first end, and the pocket liner third end, wherein the means for attachment is not visible from the exterior environment. A further means for attachment is utilized for the panel distal end, the hem first end, and the hem second end. Finally, yet another means for attachment is provided for the hem second end and the pocket liner fourth end, wherein the pocket liner opening is not visible or accessible from the exterior environment with access to the pocket liner opening from the interior environment.

These and other objects of the present invention will become more readily appreciated and understood from a consideration of the following detailed description of the exemplary embodiments of the present invention when taken together with the accompanying drawings, in which;

REFERENCE NUMBER IN DRAWINGS

Figure 1:
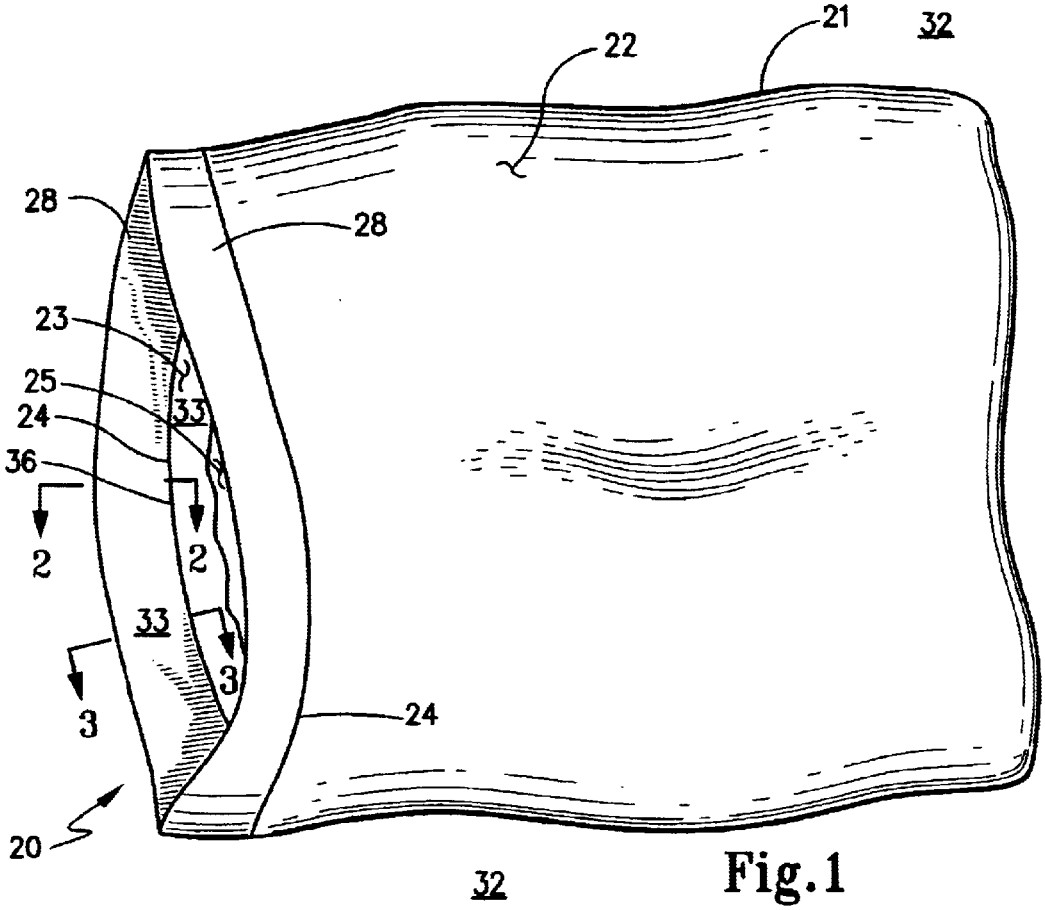
FIG. 1 shows a perspective view of the article of bedding with the hidden pocket assembly.

20 Article of bedding with hidden pocket assembly
21 Fabric panel
22 Fabric panel exterior surface
23 Fabric panel interior surface
24 Fabric panel distal end portion
25 Pillow
26 Item shown as a condom package
28 Hem fabric piece
29 Hem fabric piece first end portion
30 Hem fabric piece second end portion
31 Hem fabric piece interior volume
32 Exterior environment
33 Interior environment
35 Fabric pocket liner
36 Fabric pocket liner opening
37 Fabric pocket liner third end portion
38 Fabric pocket liner fourth end portion
39 Means for selectively securing pocket liner opening
42 Means for attachment of distal end portion, first end portion, and third end portion
43 Means for attachment of distal end portion, first end portion, and second end portion
44 Means for attachment of second end portion and fourth end portion
45 Means for attachment of fourth end portion and means for securing pocket liner opening
46 Means for attachment of distal end portion, first end portion, second end portion, and third end portion
48 Article of bedding with partially hidden pocket assembly
50 Alternative embodiment of bedding with partially hidden pocket assembly

DETAILED DESCRIPTION

Figure 2:
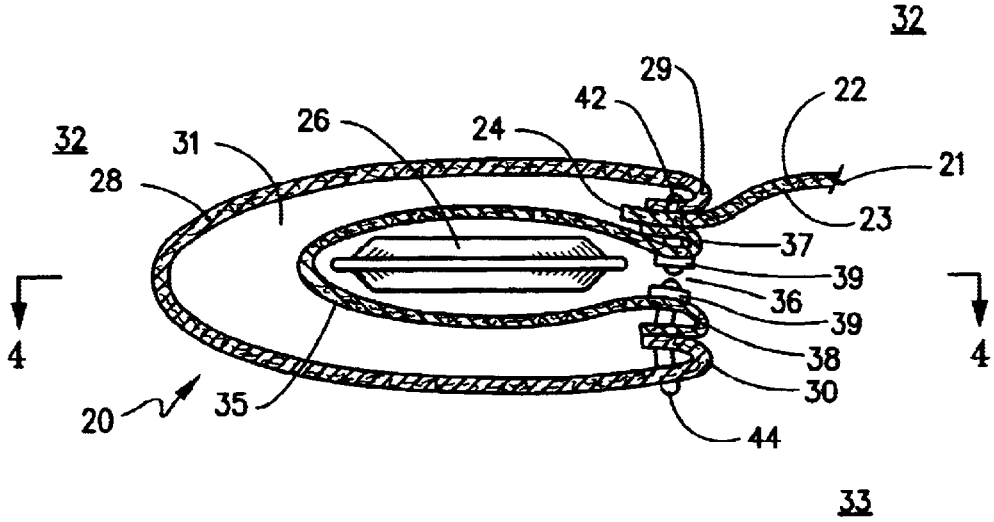
FIG. 2 shows cross sectional view 2—2 of FIG. 1 for the hidden pocket assembly mounted within the hem fabric piece.
Figure 3:
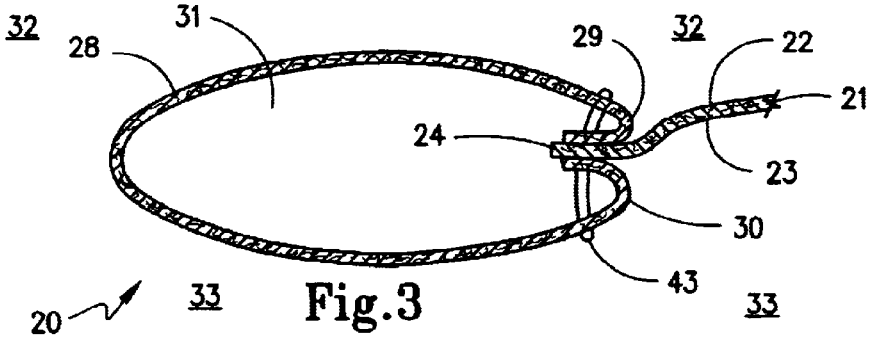
FIG. 3 shows cross sectional view 3—3 of FIG. 1 and of FIG. 5 for the hem fabric piece without the hidden or partially pocket assembly.
Figure 4:
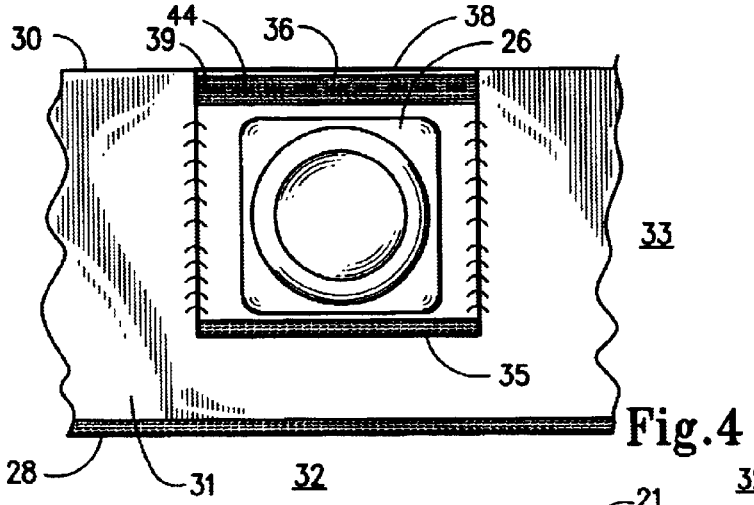
FIG. 4 shows cross sectional view 4—4 of FIG. 2 for the hidden pocket assembly mounted within the hem fabric piece.

With initial reference to FIGS. 1 through 4, the article of bedding with hidden pocket assembly 20 is described. Specifically, FIG. 1 shows a perspective view of the article of bedding with the hidden pocket assembly 20, FIG. 2 shows cross sectional view 2—2 of FIG. 1 for the hidden pocket assembly 35 mounted within the hem fabric piece 28, FIG. 3 then shows cross sectional view 3—3 of FIG. 1 and of FIG. 5 for the hem fabric piece 28 without the hidden 20 or partially pocket assembly 48 (in FIG. 5), and FIG. 4 shows cross sectional view 4—4 of FIG. 2 for the hidden pocket assembly 35 mounted within the hem fabric piece 28. Looking at the grouping of FIGS. 1 through 4, the article of bedding with a hidden pocket assembly 20 for storing an item 26, includes a fabric panel 21 having an exterior surface 22, an interior surface 23, and a distal end portion 24. Also, included is a double inwardly folded wide hem fabric piece 28 defining a first end portion 29 and a second end portion 30, with the hem forming a hem interior volume 31 separated from an exterior environment 32 and an interior environment 33. Note, that the wide hem fabric piece 28 could also be integral or one piece with the fabric panel 21 resulting in a single inward fold for either the first end portion 29 or the second end portion 30. As is shown in FIGS. 1 through 4, in the exemplary embodiment of the present invention in using a pillowcase for the article of bedding with the hidden pocket assembly 20, the exterior environment 32 is shown to be the environment outside of the pillowcase when in normal use with a pillow 25 looking specifically to FIG. 1. Continuing to refer to FIGS. 1 through 4, the interior environment 33, is the environment within the pillowcase or inside of the pillowcase, thus, when accounting for both the exterior environment 32 and the interior environment 33, this would cover all possible visible aspects of looking at the article of bedding with hidden pocket assembly 20 from any possible viewing orientation.

Further, looking to the fabric pocket liner 35 for storing the item 26, the fabric pocket liner 35 includes an opening 36 for passing the item 26 therethrough. The liner opening 36 is double outwardly folded defining a third end portion 37 and a fourth end portion 38. The positioning of the opening 36 is such that the opening 36 is adjacent to a portion of the first end 29, a portion of the second end 30, and a portion of the distal end 24. Also, the fabric pocket liner 35 is positioned within a portion of the hem interior volume 31, wherein the fabric pocket liner 35 is not visible from the exterior environment 32 and the interior environment 33. Optionally, a plurality of fabric pocket liners 35 could be utilized in the hem 28, specifically, within the hem interior volume 31, to create the ability to store a plurality of items 26 which may be the same or different.

In addition, also included is a means 42 for attachment of the distal end 24, the first end 29, and the third end 37, wherein the aforementioned means 42 for attachment is not visible or is hidden from the exterior environment 32. Further included, is a means 43 for attachment of the distal end 24, the first end 29, and the second end 30. Finally, included is a means 44 for attachment of the second end 30 and the fourth end 38, wherein the opening 36 is not visible or accessible from the exterior environment 32 with access to the opening 36 from the interior environment 33. Preferably, the means 42, the means 43, and the means 44 are accomplished by conventional sewing and stitching as is commonly used on articles of bedding such as a pillowcase, a bed sheet, a bed skirt, a blanket, a bedspread, a bed quilt, and the like. However, alternative methods of means for attachment for the aforementioned means for attachment being the means 42, the means 43, and the means 44 would be acceptable having the required strength and the "hidden" requirements in not being visible from the exterior environment 32, as mentioned above. These alternative means for attachment, being the means 42, the means 43, and the means 44 could utilize adhesive, heat sensitive bonding, toothed and untoothed zippers, hook and loop fasteners, snaps, tape, weaving, and the like, for the attachment of the aforementioned elements.

The article of bedding with a hidden pocket assembly 20 could also optionally further comprise a means 39 for selectively securing the pocket liner 35 opening 36 into a closed state, with the purpose being to retain the item 26 within the pocket liner 35 and to be able to selectively place the means 39 for selectively securing the pocket liner 35 opening 36 into an open state, thus, allowing the item 26 to pass through the pocket liner 35 opening 36 to remove the item 26 from the pocket liner 35. Preferably, the means 39 for selectively securing is accomplished by the use of a hook and loop fastener, however, the means 39 for selectively securing can also be accomplished by selecting from a group consisting of: a toothed zipper with a single slide, a toothed zipper with a plurality of slides, a slide zipper with a single slide, a slide zipper with a plurality of slides, a hook and loop fastener, snaps, and the like. The means 39 for selectively securing the pocket liner 35 opening 36 as defined above can be attached to the third end 37 and the fourth end 38 by use of the means 42 for attachment of the distal end 24, the first end 29, and the third end 37, and the means 44 for attachment of the second end 30 and the fourth end 38 respectively as shown in FIG. 2 and as previously described.

Also, the article of bedding with a hidden pocket assembly 20, is shown in FIGS. 1 through 4 as a pillow case, however, the article of bedding can bifurcated or split into the fabric panel 21 that is attached to the hem fabric piece 28 that contains the fabric pocket liner 35 that stores the item 26 with the aforementioned means 42, 43, and 44 for attachment. Although specifically the fabric panel 21 is shown in FIGS. 1 through 4 as a pillow case body minus the hem fabric piece 28, the fabric panel 21 could be any article of bedding such as a bed sheet, a bed skirt, a blanket, a bed spread, bed quilt, and the like. Further, the item 26 can be anything of a personal nature such as condoms, tissues, cough drops, breath freshener, medications, personal lubricants, and the like. The materials of construction for the fabric panel 21, hem fabric piece 28, and fabric pocket liner 35 are conventional article of bedding materials.

Figure 5:
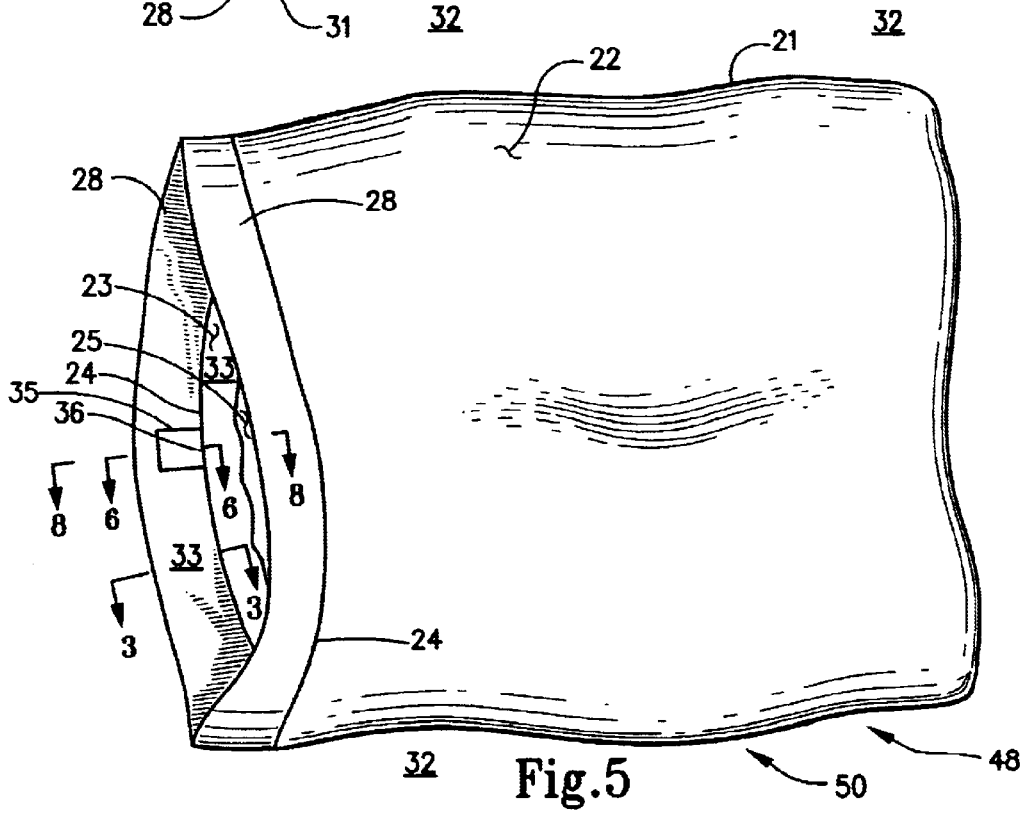
FIG. 5 shows a perspective view of the article of bedding with the partially hidden pocket assembly.
Figure 6:
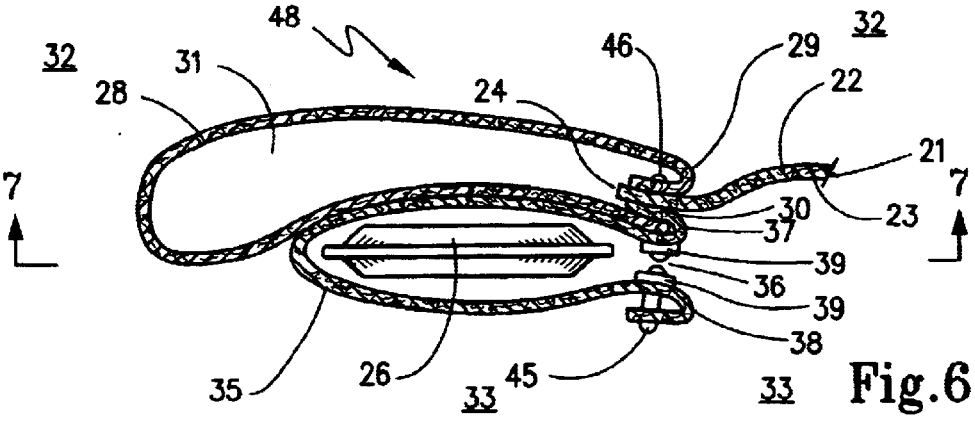
FIG. 6 shows cross sectional view 6—6 of FIG. 5 for the partially hidden pocket assembly mounted adjacent to the hem fabric piece.
Figure 7:
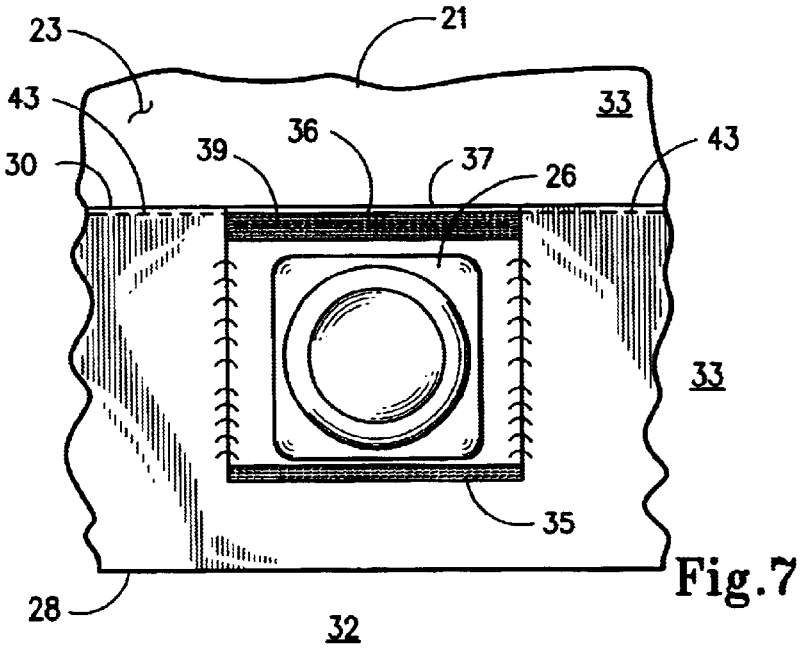
FIG. 7 shows cross sectional view 7—7 of FIG. 6 for the partially hidden pocket assembly mounted adjacent to the hem fabric piece.

Next, moving toward FIGS. 5 through 7, the article of bedding with a partially hidden pocket assembly 48 is described. Specifically, FIG. 5 shows a perspective view of the article of bedding with the partially hidden pocket assembly 48. Note, that FIG. 5 also shows cross sectional view cuts 3—3 and 6—6 that refer respectively to FIGS. 3 and 6. FIG. 6 shows cross sectional view 6—6 of FIG. 5 for the partially hidden pocket 35 assembly mounted adjacent to the hem fabric piece 28, and FIG. 7 shows cross sectional view 7—7 of FIG. 6 for the partially hidden pocket 35 assembly mounted adjacent to the hem fabric piece 28. Looking at the grouping of FIGS. 5 through 7, the article of bedding with a partially hidden pocket assembly 48 for storing an item 26, includes a fabric panel 21 having an exterior surface 22, an interior surface 23, and a distal end portion 24. Also, included is a single inwardly folded wide hem fabric piece 28 defining a first end portion 29 and a second end portion 30, with the hem forming a hem interior volume 31 separated from an exterior environment 32 and an interior environment 33. Note, that the wide hem fabric piece 28 could also be double inwardly folded as shown in FIGS. 2 and 3, with the partially hidden pocket 35 as shown in FIG. 6, being outside of the hem interior volume 31 or with the partially hidden pocket 35 being adjacent to the hem fabric piece 28. In other words, the second end portion 30 can either be non folded as shown in FIG. 6, or folded inward as shown in FIG. 2 in the area where the partially hidden pocket 35 is adjacent to the hem fabric piece 28 as shown in FIG. 6. Note, that the wide hem fabric piece 28 could also be integral or one piece with the fabric panel 21 resulting in a single inward fold for either the first end portion 29 or the second end portion 30. As is shown and in FIGS. 5 through 7, in looking at the pillowcase for the article of bedding with the partially hidden pocket assembly 48, the exterior environment 32 is shown to be the environment outside of the pillowcase when in normal use with a pillow 25 looking specifically to FIG. 5. Continuing to refer to FIG. 5, the interior environment 33, is the environment within the or inside of the pillowcase, thus, when accounting for both the exterior environment 32 and the interior environment 33 this would cover all possible visible aspects of looking at the article of bedding with partially hidden pocket assembly 48 from any possible viewing orientation.

Further, looking to the fabric pocket liner 35 for storing the item 26, the fabric pocket liner 35 includes an opening 36 for passing the item 26 therethrough. The liner opening 36 is double outwardly folded defining a third end portion 37 and a fourth end portion 38. The positioning of the opening 36 is such that the opening 36 is adjacent to a portion of the first end 29, the second end 30, and the distal end 24, also the fabric pocket liner 35 is positioned adjacent to the hem 28, wherein the fabric pocket liner 35 is not visible from the exterior environment 32 and the fabric pocket liner 35 is visible from the interior environment 33 as shown in FIG. 5. The opening 36 is not visible or accessible from the exterior environment 32 with access to the opening 36 from the interior environment 33. Optionally, a plurality of fabric pocket liners 35 could be utilized adjacent to the hem 28, to create the ability to store a plurality of items 26 which may be the same or different.

In addition, also included is a means 46 for attachment of the distal end 24, the first end 29, second end 30, and the third end 37, wherein the aforementioned means 46 for attachment is not visible or hidden from the exterior environment 32. Further included, is a means 43 for attachment of the distal end 24, the first end 29, and the second end 30 as shown in FIG. 3, wherein FIG. 3 shows the hem 28 portion without the pocket 35 being adjacent to the hem 28 portion. Preferably, the means 46 and the means 43 are accomplished by conventional sewing and stitching as is commonly used on articles of bedding such as a pillowcase, a bed sheet, a bed skirt, a blanket, a bedspread, a bed quilt, and the like. However, alternative methods of means for attachment for the aforementioned means for attachment being the means 46 and the means 43 would be acceptable having the required strength and "hidden" requirements in not being visible from the exterior environment 32, as mentioned above. These alternative means for attachment, being the means 46 and the means 43 could utilize adhesive, heat sensitive bonding, toothed and untoothed zippers, hook and loop fasteners, snaps, tape, weaving, and the like for the attachment of the aforementioned elements.

The article of bedding with the partially hidden pocket assembly 48 could also optionally further comprise a means 39 for selectively securing the pocket liner 35 opening 36 into a closed state, with the purpose being to retain the item 26 within the pocket liner 35 and to be able to selectively place the means 39 for selectively securing the pocket liner 35 opening 36 into an open state, thus, allowing the item 26 to pass through the pocket liner 35 opening 36 to remove the item 26 from the pocket liner 35. Preferably, the means 39 for selectively securing is accomplished by the use of a hook and loop fastener, however, the means 39 for selectively securing can also be accomplished by selecting from a group consisting of: a toothed zipper with a single slide, a toothed zipper with a plurality of slides, a slide zipper with a single slide, a slide zipper with a plurality of slides, a hook and loop fastener, snaps, and the like. The means 39 for selectively securing the pocket liner 35 opening 36 as defined above can be attached to the third end 37 and the fourth end 38 by use of the means 46 for attachment of the distal end 24, the first end 29, the second end 30, and the third end 37 and the means 45 for attachment of the fourth end 38 and the means 39 for selectively securing the pocket liner 35 opening 36 as shown in FIG. 6. Note, that the means 45 for attachment is constructed the same as the aforementioned means 46 for attachment.

Also, the article of bedding with the partially hidden pocket assembly 48, is shown in FIGS. 5 through 7 as a pillow case, however, the article of bedding can bifurcated or split into the fabric panel 21 that is attached to the hem fabric piece 28 that is adjacent to the fabric pocket liner 35 that stores the item 26 with the aforementioned means 46 and 43 for attachment. Although, specifically the fabric panel 21 is shown in FIGS. 5 through 7 as a pillow case body minus the hem fabric piece 28, the fabric panel 21 could be any article of bedding such as a bed sheet, a bed skirt, a blanket, a bed spread, bed quilt, and the like. Further, the item 26 can be anything of a personal nature such as condoms, tissues, cough drops, breath freshener, medications, personal lubricants, and the like. The materials of construction for the fabric panel 21, hem fabric piece 28, and fabric pocket liner 35 are conventional article of bedding materials.

Figure 8:
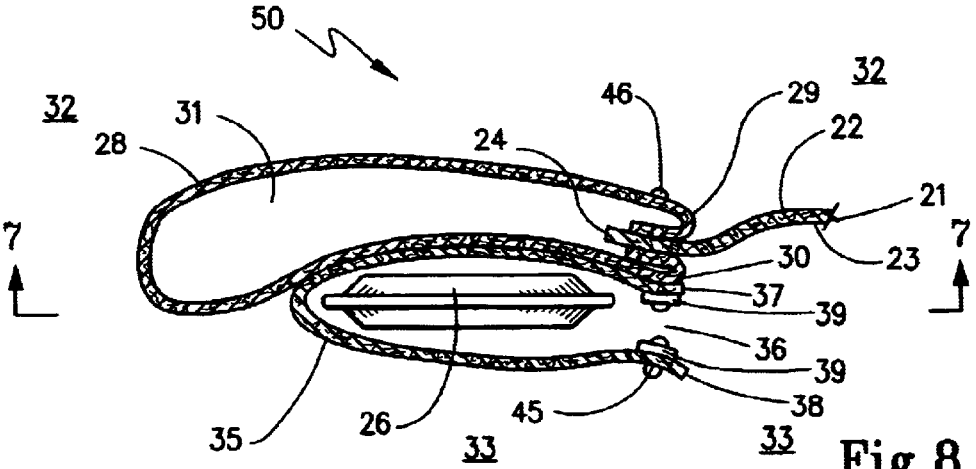
FIG. 8 shows an alternative embodiment of cross sectional view 8—8 of FIG. 5 for the partially hidden pocket assembly mounted adjacent to the hem fabric piece.

Finally looking to FIG. 8 shown is an alternative embodiment of cross sectional view 8—8 of FIG. 5 for the partially hidden pocket assembly 50 mounted adjacent to the hem fabric piece 28 possibly as in the situation of adding the partially hidden pocket assembly 50 to an existing article of bedding. Specifically, referring to FIGS. 5, 7, and 8, the alternative embodiment of the article of bedding with a partially hidden pocket assembly 50 is described. More particularly, FIG. 5 shows a perspective view of the alternative embodiment of the article of bedding with the partially hidden pocket assembly 50. Note, that FIG. 5 also shows cross sectional view cuts 3—3 and 8—8 that refer respectively to FIGS. 3 and 8. FIG. 8 shows cross sectional view 8—8 of FIG. 5 for the partially hidden pocket 35 assembly mounted adjacent to the hem fabric piece 28, and FIG. 7 shows cross sectional view.7—7 of FIG. 8 for the partially hidden pocket 35 assembly mounted adjacent to the hem fabric piece 28. Looking at the grouping of FIGS. 5, 7, and 8 the article of bedding with a partially hidden pocket assembly 50 for storing an item 26, includes a fabric panel 21 having an exterior surface 22, an interior surface 23, and a distal end 24. Also, included is a double inwardly folded wide hem fabric piece 28 as shown in FIGS. 2, 3, and 8 with the double inwardly folded wide hem fabric piece 28 defining a first end portion 29 and a second end portion 30, with the hem forming a hem interior volume 31 separated from an exterior environment 32 and an interior environment 33. Note, that the wide hem fabric piece 28 could also be integral or one piece with the fabric panel 21 resulting in a single inward fold for either the first end portion 29 or the second end portion 30. The alternative embodiment of the partially hidden pocket assembly 50 has the partially hidden pocket 35 as shown in FIG. 8, being outside of the hem interior volume 31 or with the partially hidden pocket 35 being adjacent to the hem fabric piece 28. As is shown and in FIGS. 5, 7, and 8 in looking at the pillowcase for the article of bedding with the partially hidden pocket assembly 50, the exterior environment 32 is shown to be the environment outside of the pillowcase when in normal use with a pillow 25 looking specifically to FIG. 5. Continuing to refer to FIG. 5, the interior environment 33, is the environment within the pillowcase or inside of the pillowcase, thus, when accounting for both the exterior environment 32 and the interior environment 33 this would cover all possible visible aspects of looking at the article of bedding with partially hidden pocket assembly 50 from any possible viewing orientation.

Further, looking to the fabric pocket liner 35 for storing the item 26, the fabric pocket liner 35 includes an opening 36 for passing the item 26 therethrough. The liner opening 36 defines a third end portion 37 and a fourth end portion 38. The positioning of the opening 36 is such that the opening 36 is adjacent to a portion of the first end 29, the second end 30, and the distal end 24, also the fabric pocket liner 35 is positioned adjacent to the hem 28, wherein the fabric pocket liner 35 is not visible from the exterior environment 32 and the fabric pocket liner 35 is visible from the interior environment 33 as shown in FIG. 5. The opening 36 is not visible or accessible from the exterior environment 32 with access to the opening 36 from the interior environment 33. Optionally, a plurality of fabric pocket liners 35 could be utilized adjacent to the hem 28, to create the ability to store a plurality of items 26 which may be the same or different.

In addition, also included is a means 46 for attachment of the distal end 24, the first end 29, second end 30, and the third end 37, wherein the aforementioned means 46 for attachment is visible from the exterior environment 32. Further included, is a means 43 for attachment of the distal end 24, the first end 29, and the second end 30 as shown in FIG. 3, wherein FIG. 3 shows the hem 28 portion without the pocket 35 being adjacent to the hem 28 portion. However, the means 43 would already be existing if the alternative embodiment of the partially hidden pocket assembly 50 with the partially hidden pocket 35 were added to an existing article of bedding. Preferably, the means 46 and the means 43 are accomplished by conventional sewing and stitching as is commonly used on articles of bedding such as a pillowcase, a bed sheet, a bed skirt, a blanket, a bedspread, a bed quilt, and the like. However, alternative methods of means for attachment for the aforementioned means for attachment being the means 46 and the means 43 would be acceptable having the required strength requirements. These alternative means for attachment, being the means 46 and the means 43 could utilize adhesive, heat sensitive bonding, toothed and untoothed zippers, hook and loop fasteners, snaps, tape, weaving, and the like for the attachment of the aforementioned elements.

The article of bedding with the partially hidden pocket assembly 50 could also optionally further comprise a means 39 for selectively securing the pocket liner 35 opening 36 into a closed state, with the purpose being to retain the item 26 within the pocket liner 35 and to be able to selectively place the means 39 for selectively securing the pocket liner 35 opening 36 into an open state, thus, allowing the item 26 to pass through the pocket liner 35 opening 36 to remove the item 26 from the pocket liner 35. Preferably, the means 39 for selectively securing is accomplished by the use of a hook and loop fastener, however, the means 39 for selectively securing can also be accomplished by selecting from a group consisting of a toothed zipper with a single slide, a toothed zipper with a plurality of slides, a slide zipper with a single slide, a slide zipper with a plurality of slides, a hook and loop fastener, snaps, and the like. The means 39 for selectively securing the pocket liner 35 opening 36 as defined above can be attached to the third end 37 and the fourth end 38 by use of the means 46 for attachment of the distal end 24, the first end 29, the second end 30, and the third end 37 and the means 45 for attachment of the fourth end 38 and the means 39 for selectively securing the pocket liner 35 opening 36 as shown in FIG. 8. Note, that the means 45 for attachment is constructed the same as the aforementioned means 46 for attachment.

Also, the article of bedding with the partially hidden pocket assembly 50, is shown in FIGS. 5, 7, and 8 as a pillow case, however, the article of bedding can bifurcated or split into the fabric panel 21 that is attached to the hem fabric piece 28 that is adjacent to the fabric pocket liner 35 that stores the item 26 with the aforementioned means 46 and 43 for attachment. Although, specifically the fabric panel 21 is shown in FIGS. 5, 7, and 8 as a pillow case body minus the hem fabric piece 28, the fabric panel 21 could be any article of bedding such as a bed sheet, a bed skirt, a blanket, a bed spread, bed quilt, and the like. Further, the item 26 can be anything of a personal nature such as condoms, tissues, cough drops, breath freshener, medications, personal lubricants, and the like. The materials of construction for the fabric panel 21, hem fabric piece 28, and fabric pocket liner 35 are conventional article of bedding materials.

CONCLUSION

Accordingly, the present invention of an article of bedding with hidden or partially hidden pocket assembly has been described with some degree of particularity directed to the embodiments of the present invention. It should be appreciated, though, that the present invention is defined by the following claims construed in light of the prior art so modifications the changes may be made to the exemplary embodiments of the present invention without departing from the inventive concepts contained therein.

What is claimed is:

1. An article of bedding with a hidden pocket assembly for storing an item, comprising:

(a) a fabric panel including an exterior surface, an interior surface, and a distal end portion;

(b) a double inwardly folded wide hem fabric piece defining a first end portion and a second end portion, said hem forming a hem interior volume separated from an exterior environment and an interior environment;

(c) a fabric pocket liner for storing the item, said fabric pocket liner including an opening for passing the item therethrough wherein said liner opening is double outwardly folded defining a third end portion and a fourth end portion, said opening is adjacent to a portion of said first end, said second end, and said distal end, said fabric pocket liner is positioned within a portion of said hem interior volume, wherein said fabric pocket liner is not visible from said exterior environment and said interior environment;

(d) means for attachment of said distal end, said first end, and said third end, wherein said means is not visible from said exterior environment;

(e) means for attachment of said distal end, said first end, and said second end; and (f) means for attachment of said second end and said fourth end, wherein said opening is not visible or accessible from said exterior environment with access to said opening from said interior environment.

2. An article of bedding with a hidden pocket assembly according to claim 1 further comprising a means for selectively securing said pocket liner opening in a closed state to retain the item within said pocket liner and to selectively place said means for selectively securing said pocket liner opening into an open state allowing the item to pass through said pocket liner opening to remove the item from said pocket.

3. An article of bedding with a hidden pocket assembly according to claim 2 wherein said means for selectively securing is selected from a group consisting of: a toothed zipper with a single slide, a toothed zipper with a plurality of slides, a slide zipper with a single slide, a slide zipper with a plurality of slides, a hook, and loop fastener, and snaps.

4. An article of bedding with a hidden pocket assembly according to claim 1 wherein said means for attachment of said distal end, said first end, and said third end is accomplished by stitching.

5. An article of bedding with a hidden pocket assembly according to claim 1 wherein said means for attachment of said distal end, said first end, and said second end is accomplished by stitching.

6. An article of bedding with a hidden pocket assembly according to claim 1 wherein said means for attachment of said second end and said fourth end is accomplished by stitching.

7. An article of bedding with a hidden pocket assembly according to claim 1 wherein said fabric panel is a pillowcase.

8. An article of bedding with a hidden pocket assembly according to claim 1 wherein said fabric panel is a bed sheet.

9. An article of bedding with a hidden pocket assembly according to claim 1 wherein said fabric panel is a bed skirt.

10. An article of bedding with a hidden pocket assembly according to claim 1 wherein said fabric panel is a blanket.

11. An article of bedding with a hidden pocket assembly according to claim 1 wherein said fabric panel is a bed spread.

12. An article of bedding with a hidden pocket assembly according to claim 1 wherein said fabric panel is a bed quilt.

13. An article of bedding with a hidden pocket assembly according to claim 1 further comprising a plurality of said fabric pocket liners.

14. An article of bedding with a partially hidden pocket assembly for storing an item, comprising:

(a) a fabric panel including an exterior surface, an interior surface, and a distal end portion;

(b) a single inwardly folded wide hem fabric piece defining a first end portion and a second end portion, said hem forming a hem interior volume separated from an exterior environment and an interior environment;

(c) a fabric pocket liner for storing the item, said fabric pocket liner including an opening for passing the item therethrough wherein said liner opening is double outwardly folded defining a third end portion and a fourth end portion, said opening is adjacent to a portion of said first end, said second end, and said distal end, said fabric pocket liner is positioned adjacent to said hem, wherein said fabric pocket liner is not visible from said exterior environment and said pocket liner is visible from said interior environment;

(d) means for attachment of said distal end, said first end, said second end, and said third end, wherein said means is not visible from said exterior environment; and (e) means for attachment of said distal end, said first end, and said second end, wherein said opening is not visible or accessible from said exterior environment with access to said opening from said interior environment.

15. An article of bedding with a partially hidden pocket assembly according to claim 14 further comprising a means for selectively securing said pocket liner opening in a closed state to retain the item within said pocket liner and to selectively place said means for selectively securing said pocket liner opening into an open state allowing the item to pass through said pocket liner opening to remove the item from said pocket.

16. An article of bedding with a partially hidden pocket assembly according to claim 15 wherein said means for selectively securing is selected from a group consisting of: a toothed zipper with a single slide, a toothed zipper with a plurality of slides, a slide zipper with a single slide, a slide zipper with a plurality of slides, a hook and loop fastener, and snaps.

17. An article of bedding with a partially hidden pocket assembly according to claim 14 wherein said means for attachment of said distal end, said first end, said second end, and said third end is accomplished by stitching.

18. An article of bedding with a partially hidden pocket assembly according to claim 14 wherein said means for attachment of said distal end, said first end, and said second end is accomplished by stitching.

19. An article of bedding with a partially hidden pocket assembly according to claim 14 wherein said fabric panel is a pillowcase.

20. An article of bedding with a partially hidden pocket assembly according to claim 14 wherein said fabric panel is a bed sheet.

21. An article of bedding with a partially hidden pocket assembly according to claim 14 wherein said fabric panel is a bed skirt.

22. An article of bedding with a partially hidden pocket assembly according to claim 14 wherein said fabric panel is a blanket.

23. An article of bedding with a partially hidden pocket assembly according to claim 14 wherein said fabric panel is a bed spread.

24. An article of bedding with a partially hidden pocket assembly according to claim 14 wherein said fabric panel is a bed quilt.

25. An article of bedding with a partially hidden pocket assembly according to claim 14 further comprising a plurality of said fabric pocket liners.

26. An article of bedding with a partially hidden pocket assembly for storing an item, comprising:

(a) a fabric panel including an exterior surface, an interior surface, and a distal end portion;

(b) a double inwardly folded wide hem fabric piece defining a first end portion and a second end portion, said hem forming a hem interior volume separated from an exterior environment and an interior environment;

(c) a fabric pocket liner for storing the item, said fabric pocket liner including an opening for passing the item therethrough wherein said liner opening is defines a third end portion and a fourth end portion, said opening is adjacent to a portion of said first end, said second end, and said distal end, said fabric pocket liner is positioned adjacent to said hem, wherein said fabric pocket liner is not visible from said exterior environment and said pocket liner is visible from said interior environment; and (d) means for attachment of said distal end, said first end, said second end, and said third end, wherein said opening is not visible or accessible from said exterior environment with access to said opening from said interior environment.

27. An article of bedding with a partially hidden pocket assembly according to claim 26 further comprising a means for selectively securing said pocket liner opening in a closed state to retain the item within said pocket liner and to selectively place said means for selectively securing said pocket liner opening into an open state allowing the item to pass through said pocket liner opening to remove the item from said pocket.

28. An article of bedding with a partially hidden pocket assembly according to claim 27 wherein said means for selectively securing is selected from a group consisting of: a toothed zipper with a single slide, a toothed zipper with a plurality of slides, a slide zipper with a single slide, a slide zipper with a plurality of slides, a hook and loop fastener, and snaps.

29. An article of bedding with a partially hidden pocket assembly according to claim 26 wherein said means for attachment of said distal end, said first end, said second end, and said third end is accomplished by stitching.

30. An article of bedding with a partially hidden pocket assembly according to claim 26 wherein said fabric panel is a pillowcase.

31. An article of bedding with a partially hidden pocket assembly according to claim 26 wherein said fabric panel is a bed sheet.

32. An article of bedding with a partially hidden pocket assembly according to claim 26 wherein said fabric panel is a bed skirt.

33. An article of bedding with a partially hidden pocket assembly according to claim 26 wherein said fabric panel is a blanket.

34. An article of bedding with a partially hidden pocket assembly according to claim 26 wherein said fabric panel is a bed spread.

35. An article of bedding with a partially hidden pocket assembly according to claim 26 wherein said fabric panel is a bed quilt.

36. An article of bedding with a partially hidden pocket assembly according to claim 26 further comprising a plurality of said fabric pocket liners.

* * * * *